United States Patent [19]

Parat et al.

[11] 4,352,598

[45] Oct. 5, 1982

[54] CONCRETE STRUCTURE FOR THE TRANSMISSION OF LOADS FROM THE STEEL LATTICE OF A MARINE PLATFORM AND A METHOD OF FORMING SAID STRUCTURE

[75] Inventors: Hubert J. L. Parat; Dominique Michel, both of Paris; Francois G. Sedillot, Vélizy, all of France

[73] Assignee: Compagnie Generale pour les Developpements Operationnels des Richesses Sous-Marines "C.G. Doris", Paris, France

[21] Appl. No.: 118,917

[22] Filed: Feb. 6, 1980

[30] Foreign Application Priority Data

Feb. 7, 1979 [FR] France ..... 79 03108

[51] Int. Cl.[3] ..... E02B 17/00; E02D 29/06

[52] U.S. Cl. ..... 405/222; 52/655

[58] Field of Search ..... 405/195, 197, 207, 220, 405/222, 223, 224; 52/169.8, 246, 247, 40, 194, 433, 655, 649, 725, 741; 403/265, 263, 266, 269, 244, 361; 264/35

[56] References Cited

U.S. PATENT DOCUMENTS

| | | | |
|---|---|---|---|
| 1,858,512 | 5/1932 | Langenberg et al. | 52/725 |
| 3,496,728 | 2/1970 | Slack | 52/655 |
| 3,791,154 | 2/1974 | Crain | 52/655 |
| 4,064,669 | 12/1977 | Vik | 52/741 |
| 4,218,859 | 8/1980 | Sams | 52/194 |

FOREIGN PATENT DOCUMENTS

| | | | |
|---|---|---|---|
| 2253380 | 6/1975 | France | 405/207 |
| 2270390 | 12/1975 | France | 405/207 |
| 2309749 | 11/1976 | France | 405/195 |
| 460104 | 10/1950 | Italy | 52/433 |
| 611907 | 11/1948 | United Kingdom | 52/40 |
| 1386327 | 3/1975 | United Kingdom | 405/207 |
| 1460374 | 1/1977 | United Kingdom | 405/207 |

*Primary Examiner*—David H. Corbin
*Assistant Examiner*—Nancy J. Pistel
*Attorney, Agent, or Firm*—Laurence R. Brown

[57] ABSTRACT

A concrete structure for the transmission of loads from the steel lattice tower of a marine platform resting on the sea bed by means of concrete base plates, the lattice tower being made up of tubular members which form bracing joints with the legs of the platform. The structure comprises a cylindrical hollow body forming at least part of a platform leg, and having on the inside enclosed spaces defined by internal walls and by the hollow body wall, and concrete fixing plugs formed within the enclosed spaces and engaged by the ends of the lattice members, the enclosed spaces being in the form of hollow rings or vertical shafts within the hollow body.

10 Claims, 12 Drawing Figures

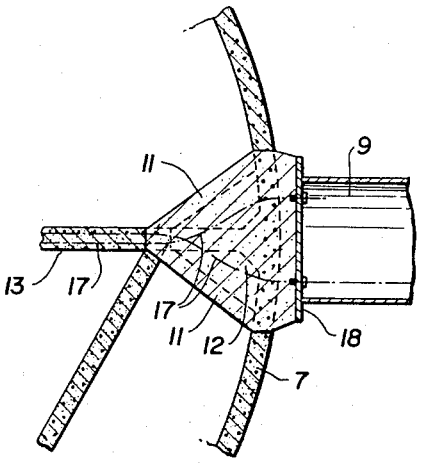
FIG. 8
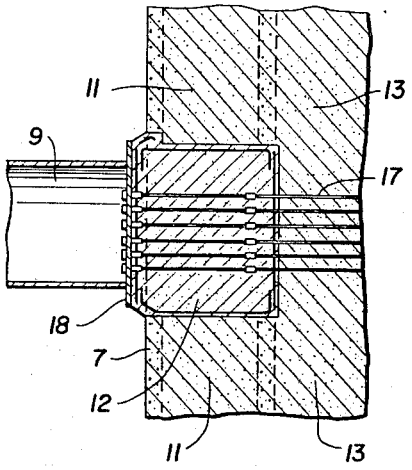
FIG. 9
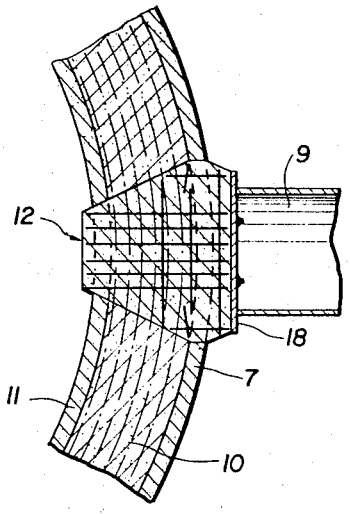
FIG. 10
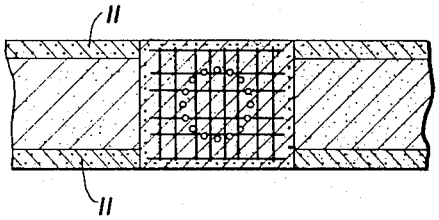
FIG. 11
FIG. 12
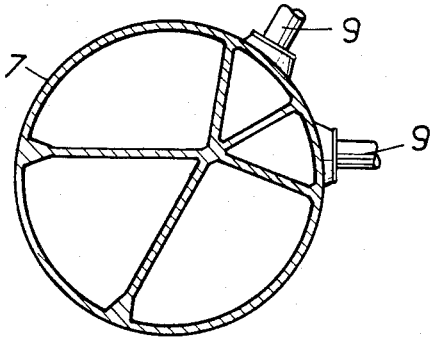

CONCRETE STRUCTURE FOR THE TRANSMISSION OF LOADS FROM THE STEEL LATTICE OF A MARINE PLATFORM AND A METHOD OF FORMING SAID STRUCTURE

This invention relates to a concrete structure, and a method for forming the said structure, for the transmission of loads from the steel lattice of a marine platform of the kind comprising a steel lattice tower extended by concrete base plates resting on the sea bed.

Platforms are known which are composed principally of a steel lattice tower with vertical columns forming feet, these columns being driven into the sea bed by piers to which they are then fixed. In order to distribute appropriately the loads caused by the swell and other natural forces, the members of the lattice tower converge where they join the columns to form bracing joints which, where tubes of several meters diameter are involved, are complex structures reinforced to avoid concentration of stress.

So as to avoid or lessen the task of driving in the piers, the towers have been set into concrete on the base plates, giving the platform the characteristic of a massive base. Since it is necessary to provide means for lightening and adjusting the buoyancy of the tower, floats are used which can be fixed or removable, and which can be placed on the free parts of the base plates. Frequently the floats are retained and are used in the permanent ballasting of the platform. Each float thus forms a structure of considerable height and of questionable usefulness.

This invention sets out to provide a vertical structure which can be used as a float or reservoir and which is capable of replacing the vertical columns of the steel lattice corresponding to the lower portion of the tower.

According to the invention there is provided a concrete structure for the transmission of loads from the steel lattice of a marine platform resting on the sea bed by means of concrete base plates, the lattice being made up of members which form bracing joints with the legs of the platform, wherein the structure comprises a cylindrical hollow body forming at least part of the legs fixed to the base plates, the hollow body having on the inside, at least at the level of the ends of the lattice members, enclosed spaces defined by concrete walls and by part of the hollow body, and fixing plugs, at least a part of each fixing plug being defined by the walls of part of the enclosed space, and by the end of the associated lattice member.

The invention also provides a method of forming such a concrete structure wherein spaces are formed in the wall of the hollow body and in said walls defining said enclosed spaces, in the area provided for connection of the lattice members, the members, fitted with connecting plates, are put in position, a forming frame is formed, one of the sides of which is made up of the connecting plate, the other sides enclosing said spaces formed in said walls, means for fixing the plate are put in position, concrete is poured into the frame to form the fixing plug, and, after removal of the frame, the plate is fixed on to the structure.

The following is a more detailed description of various embodiments of the invention, reference being made to the accompanying drawings in which:

FIG. 1 is a diagrammatic view of a conventional bracing joint of a platform leg structure, FIG. 2 is a diagrammatic view of a hollow body, and base plate, to which the lattice members are connected, in accordance with the invention, FIG. 3 is a view along the line III—III of FIG. 2, FIG. 4 is a diagrammatic view from above along the line III—III of FIG. 2 of a tower resting on three base plates, FIG. 5 is a diagrammatic view of a hollow body which has hollow rings to which the lattice members are connected, FIGS. 6 and 7 are views along the lines VI—VI and VII—VII of FIG. 5, FIGS. 8 and 9 are horizontal and vertical fragments of a connecting plug according to FIG. 3, FIGS. 10 and 11 are horizontal and vertical fragments of a connecting plug according to FIG. 5, and FIG. 12 is a sectional view of another embodiment of the invention.

FIG. 1 is a diagrammatic view of a bracing joint of a platform structure. The vertical columns 1, forming feet, have connecting sleeves 2 comprising internal stiffeners 20 in which are fixed horizontal lattice members 3 and inclined lattice members 4 which also comprise stiffeners 30 and 40. These sleeves are complex constructions and connections formed in this manner require precise positioning of the members. This is a delicate operation when it is carried out on site and with tubular members of very large diameter.

The object of the present invention is to avoid these requirements by making it possible to have variations in position of up to 0.50 m., without the structure requiring special modification.

FIGS. 2 and 5 show embodiments of the invention in which a concrete leg structure 5 with a cap 8 is used for the transmission of loads from the steel lattice of a marine platform resting on the sea bed by means of concrete base plates 6. The structure comprises a hollow cylindrical body 7 forming at least part of the legs of the platform. The hollow body (FIGS. 3 and 6) has, on the inside, at the level of the members 9 of the lattice, enclosed spaces 10, defined by concrete walls 11 and by a portion of the hollow body, and plugs 12 for fixing the members. The fixing plugs have at least part of their surfaces formed by the walls 11 of the enclosed spaces 10 and by the ends of the members 9.

The enclosed spaces 10 (FIGS. 2 and 3) form vertical shafts which, according to the embodiment of the invention shown, are cylindrical sectors on a vertical axis.

FIG. 4, being a plan view and diagrammatic view at the same level as that of FIG. 3, shows the fixing of a tower by means of three base plates 6 defining a triangle, the lattice members extending along the sides of the triangle. The members along two adjacent sides of the triangle which, in a bracing joint of a conventional steel lattice have their ends very close to one another, have the advantage of being connected to the hollow body with a quite considerable distance between them.

The axis of each enclosed space 10 is preferably intersected by the axes of the associated members 9. In the case of the spaces 10 (FIG. 3) which have the form of a cylindrical sector on a vertical axis, the apex of each sector lies in the plane defined by the axes of the associated members which are on one side of the lattice tower. The apex is extended by at least one concrete wall 13 integral with the base plate 6 and supported on the wall of the hollow body.

The concrete walls 13 lie in the planes of the axes of the members on adjacent sides of the platform and the walls 13 intersect, in this embodiment of the invention, at the centre of the hollow body. This intersection, which in effect forms a girder, represents the point of action of the bracing joints. In order to distribute the load over the whole of the hollow body and the base, at least one wall 14, extending in a plane bisecting the angle between the vertical planes defined by the axes of the members 9, is supported directly or indirectly on the cylindrical wall of the hollow body. The apices of the spaces 10 may be connected by a wall 130 to provide good distribution of load at the level of the walls 13.

Alternatively, each wall 13 and 14 may comprise a flat single wall which extends the apex of its associated space 10 and is supported on the cylindrical wall of the hollow body 7 in such a way that the walls extending the apices of the two spaces 10 are symmetrical in relation to the vertical plane bisecting the angle between the vertical planes defined by the axes of the members 9.

Each base plate 6 has concentric partitions 15 and radial partitions 16. Certain of these partitions are extended during construction, by the technique of sliding shuttering, so as to form the hollow body 7 and the concrete walls 13 and 14. This technique makes it possible to form the spaces 10 at the same time. During the pouring of the walls 11, to form the enclosed spaces 10, spaces are left in the area provided for the fixing plugs, these spaces leaving the reinforcement uncovered, or reinforcement being fixed into these spaces. During the fixing of the members the reinforcement will be incorporated into the plugs, which are cast if required.

FIG. 12 shows another embodiment of the invention in which the line of intersection of the vertical planes containing the axes of the members on adjacent sides of the platform is off-centre in relation to the hollow body 7. Preferably the radial partitions of the base plate will be extended as described above.

A hollow body 7 comprises on its internal wall horizontal hollow rings 10 which are arranged at heights corresponding to the positions of the ends of the members 9. According to the method used to form the rings by a conventional technique of shuttering or by assembly of prefabricated sections, spaces are left in such a way as to obtain a good connection between the cast plug and the ring. As in the previous method, the reinforcement left exposed in the spaces forms a wall of the plug, or reinforcement is incorporated in the plug. The concrete rings absorb, through the members 9, loads imposed on the steel lattice tower, and these loads are transmitted to the cylindrical hollow body 7 which, in turn, transmits the load to the sea bed.

Figure 1:
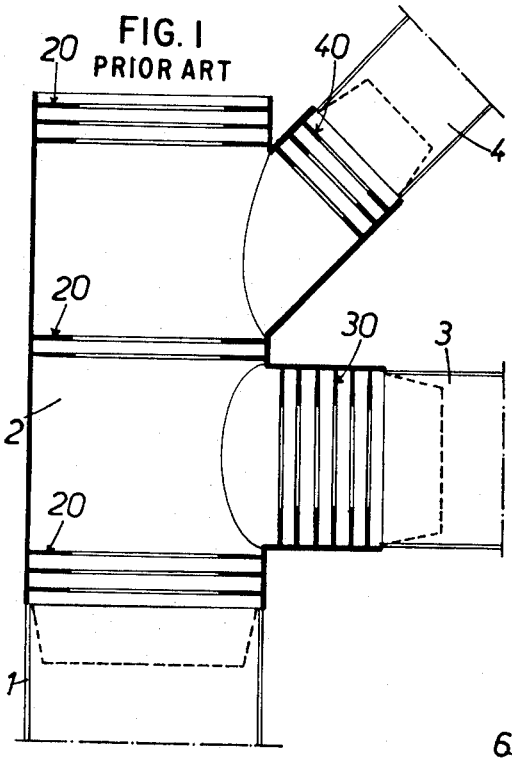
FIG. 1 PRIOR ART
Figure 2:
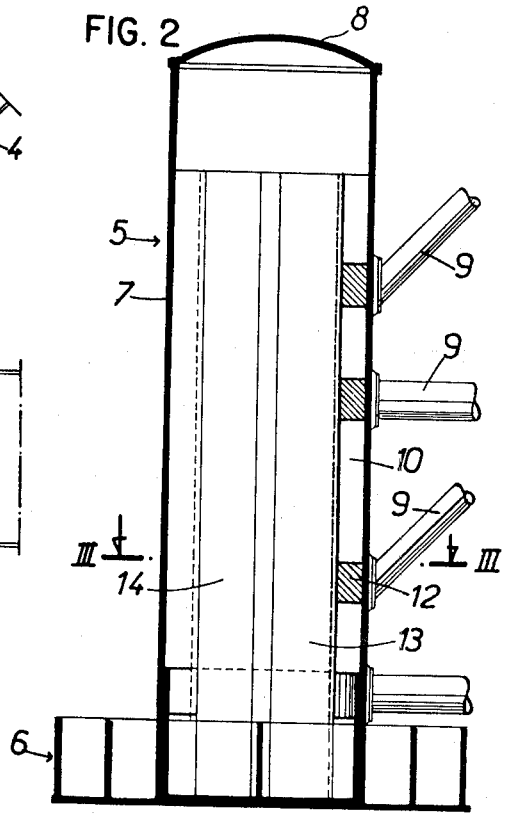
Figure 3:
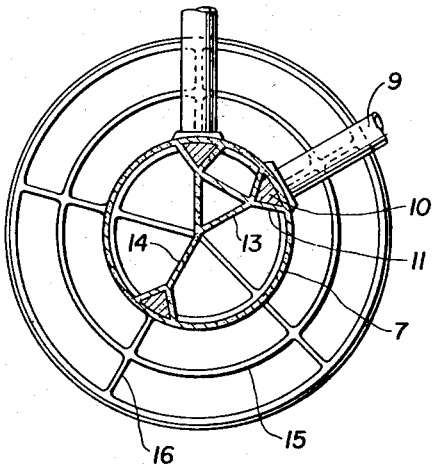
Figure 4:
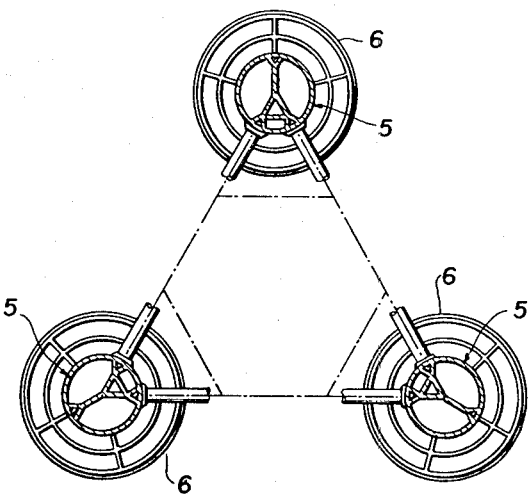
Figure 5:
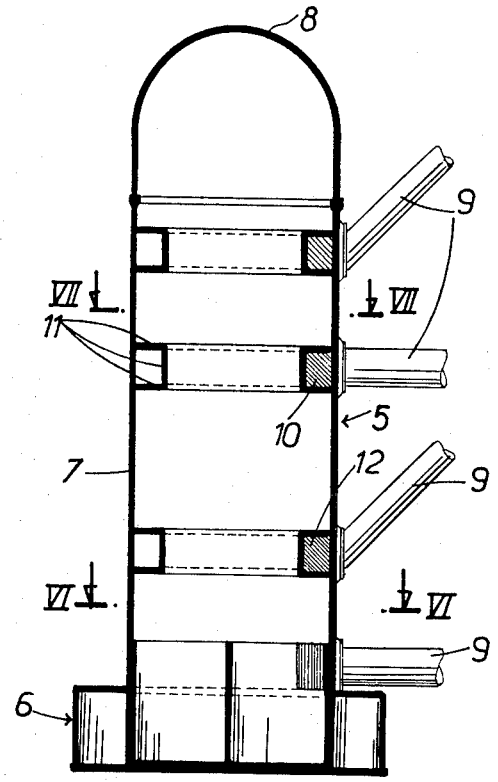
FIG. 5 shows another embodiment of the invention.
Figure 6:
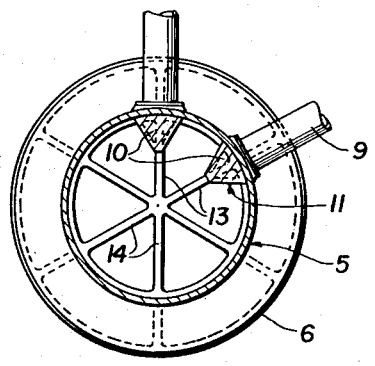
Figure 7:
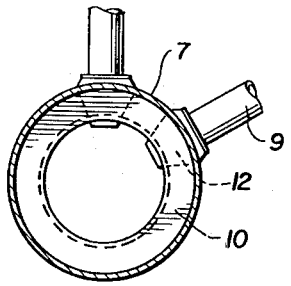

FIGS. 6 and 7 show views along the lines VI—VI and VII—VII respectively of FIG. 5. The horizontal member 9, close to the base plate, is connected to the latter by concrete walls 13 which are supported on the one hand on the walls defining the enclosed spaces 10, as shown in FIG. 3, and, on the other hand, on the wall of the hollow body by the walls 14. The walls form a structure centred on the hollow body similar to that described in the embodiment of FIGS. 2 and 3. FIG. 7, which is a view along the line VII—VII of FIG. 5, shows the hollow ring 10 into which the plugs 12 have been cast, part of the walls of the ring serving as at least part of the walls of the plugs.

The method for fixing the members 9 to the hollow body is as follows:

During construction of the hollow body 7 and concrete walls intended to distribute loads on to the wall and on to the base plate, spaces have been left at the approximate points where the members should end. Passages 17 (FIGS. 8 and 9) are also provided within the thickness of the walls 13 for the prestressed reinforcing cables or rods, these passages ending in the connecting areas. The members 9, to the ends of which connecting plates 18 have been welded, are put in position in front of the aforementioned spaces. A forming frame is made, one of the sides of which is made up of the connecting plate, the other sides defining a space enclosing the reinforcement in the spaces left in the walls. The conduits of the prestressed reinforcement cables or rods are passed from the connecting plates up to the passages. Concrete is poured into the forming frame to form the fixing plug 12. After removal of the forming frame, the plate is fixed on to the structure.

FIGS. 10 and 11 show the formation of a connecting plug in the embodiment of the invention incorporating horizontal rings, as shown in FIG. 5. The member 9, the end of which bears the connecting plate 18, is located in front of the space left in the wall of the hollow body 7. A forming frame is formed, one wall of which is provided by the plate, and the other walls of which enclose part of the walls 11 of the ring. Prestressed means are provided to ensure an efficient connection with the ring and the wall of the hollow body.

The described method of forming connecting plugs makes it possible to transmit loads from the lattice to the base plates in the best manner. Loads on the wall of the hollow body are uniformly distributed no matter what errors there may be in the positioning of lattice members. In fact, the plug, as from when it is formed, is always perfectly positioned in relation to the connecting plate of the associated member and transmits loads to the vertical partitions or to the rings and to the wall of the hollow body.

We claim:

1. A concrete structure for the transmission of loads from the steel lattice of a marine platform resting on the sea bed by means of concrete base plates, the lattice being made up of lattice members which form bracing joints with the legs of the platform, the concrete structure comprising: a base plate; a cylindrical hollow body leg member fixed to the base plate; concrete walls within the hollow body; enclosed spaces defined by said concrete walls and by part of the hollow body; and concrete fixing plugs, at least a part of each fixing plug being affixed to said walls defining the enclosed spaces and to the end of an associated lattice member.

2. A structure according to claim 1, wherein at least one wall of the enclosed spaces is formed by a hollow ring.

3. A structure according to claim 1, wherein the enclosed spaces are in the form of vertical shafts.

4. A structure according to claim 3, wherein the hollow body has a vertical axis and the enclosed spaces are in the form of cylindrical sectors on the vertical axis.

5. A structure according to claim 3, wherein the walls defining the enclosed spaces are extended inwardly in the hollow body by at least one additional concrete wall integral with the base plate and the wall of the hollow body.

6. A structure according to claim 5, wherein the hollow body defines a tower, two lattice members are axially directed to meet the hollow body and two said additional concrete walls are provided lying in vertical planes defined by the axes of the lattice members positioned on adjacent sides of the tower, the intersection of the walls forming a girder containing the points of action of the bracing joints.

7. A structure according to claim 6, wherein further concrete walls are arranged between the intersection of said additional walls and the wall of the hollow body and are symmetrical in relation to said additional walls.

8. A structure accordng to claim 1, wherein the end of the lattice member adjoining the cylindrical hollow body comprises a connecting plate.

9. Marine platform means with a concrete base structure resting on the sea bed including at least one concrete structure according to claim 1.

10. A method of forming a concrete structure according to claim 1, wherein spaces are formed in the wall of the hollow body, and in said walls defining said enclosed spaces, in the area provided for connection of the lattice members, the members, fitted with connecting plates, are put in position, a forming frame is formed, one of the sides of which is made up of the connecting plate, the other sides enclosing said spaces formed in said walls, means for fixing the plate are put in position, concrete is poured into the frame to form the fixing plug, and, after removal of the frame, the plate is fixed on to the structure.

* * * * *